US010850902B2

(12) United States Patent
Blin et al.

(10) Patent No.: US 10,850,902 B2
(45) Date of Patent: Dec. 1, 2020

(54) CARTON AND BLANK THEREFOR

(71) Applicant: WestRock Packaging Systems, LLC, Atlanta, GA (US)

(72) Inventors: Patrick Blin, Châteauroux (FR); Julien G. Merzeau, Châteauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 133 days.

(21) Appl. No.: 15/969,921

(22) Filed: May 3, 2018

(65) Prior Publication Data

US 2018/0319560 A1 Nov. 8, 2018

Related U.S. Application Data

(60) Provisional application No. 62/500,825, filed on May 3, 2017.

(51) Int. Cl.
*B65D 71/36* (2006.01)

(52) U.S. Cl.
CPC ..... *B65D 71/36* (2013.01); *B65D 2571/0016* (2013.01); *B65D 2571/0045* (2013.01); *B65D 2571/0058* (2013.01); *B65D 2571/0066* (2013.01); *B65D 2571/0087* (2013.01); *B65D 2571/00141* (2013.01); *B65D 2571/00456* (2013.01); *B65D 2571/00524* (2013.01); *B65D 2571/00574* (2013.01); *B65D 2571/00728* (2013.01); *B65D 2571/00845* (2013.01)

(58) Field of Classification Search
CPC ..... B65D 71/36; B65D 2571/00141; B65D 2571/0016; B65D 2571/0045; B65D 2571/00456; B65D 2571/00524
USPC ..... 206/170, 175, 427, 429; 229/117.13, 229/117.16, 117.17
See application file for complete search history.

(56) References Cited

U.S. PATENT DOCUMENTS

| | | | | |
|---|---|---|---|---|
| 5,197,656 | A | 3/1993 | Hoell et al. | |
| 6,968,992 | B2 * | 11/2005 | Schuster | B65D 71/36 229/117.16 |
| 8,439,254 | B2 | 5/2013 | Smalley | |
| 8,453,920 | B2 * | 6/2013 | Schemmel | B65D 71/36 206/427 |
| 9,073,680 | B2 * | 7/2015 | Kastanek | B65D 71/18 |
| 2006/0278689 | A1 | 12/2006 | Boshinski | |

(Continued)

FOREIGN PATENT DOCUMENTS

EP 0475147 A1 3/1992

*Primary Examiner* — Luan K Bui
(74) *Attorney, Agent, or Firm* — Brian J. Goldberg

(57) ABSTRACT

Aspects of the disclosure relate to a carton for packaging one or more articles, a blank for forming the carton and a method of packaging articles. The carton comprises a plurality of panels forming walls of a tubular structure including a top wall, a first side wall, a base wall, and a second side wall. An end closure structure at least partially closes an end of the tubular structure. The end closure structure includes: a top end closure flap having a handle flap which defines at least in part a handle opening in the top end closure flap for forming a carrying handle; a side end closure flap coupled to one of the first and second side walls; wherein the side end closure flap comprises a portion which underlies the handle flap when both the top and side end flaps are folded into an end-closing position.

21 Claims, 11 Drawing Sheets

(56) References Cited

U.S. PATENT DOCUMENTS

| | | | | |
|---|---|---|---|---|
| 2007/0228120 | A1* | 10/2007 | McKenna | B65D 5/46096 229/117.13 |
| 2008/0203143 | A1* | 8/2008 | Holley | B65D 5/0227 229/117.16 |
| 2008/0237325 | A1* | 10/2008 | Mittelstaedt | B65D 5/22 229/117.17 |
| 2013/0214037 | A1 | 8/2013 | Holley | |
| 2015/0246761 | A1 | 9/2015 | Holley | |
| 2018/0297744 | A1* | 10/2018 | Merzeau | B65D 5/5007 |
| 2018/0305100 | A1* | 10/2018 | Blin | B65D 71/36 |

* cited by examiner

CARTON AND BLANK THEREFOR

TECHNICAL FIELD

The present invention relates to cartons and to blanks for forming the same. More specifically, but not exclusively, the invention relates to a carrier of the wrap-around type having an end closure structure for retention of an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide article carriers or cartons in which an end closure structure is provided to retain an article within the carton.

The present invention seeks to provide an improvement in the field of cartons, typically formed from paperboard or the like.

SUMMARY

A first aspect of the invention provides a carton for packaging one or more articles. The carton comprising a plurality of panels forming walls of a tubular structure including a top wall, a first side wall, a base wall, and a second side wall, and an end closure structure for at least partially closing an end of the tubular structure. The end closure structure comprising a top end closure flap having a handle flap which defines at least in part a handle opening in the top end closure flap for forming a carrying handle and a side end closure flap coupled to one of the first and second side walls. The side end closure flap comprises a portion which underlies the handle flap when both the top and side end flaps are folded into an end-closing position. The top end closure flap includes a proximal portion and a distal glue flap hingedly connected to the proximal portion. The distal glue flap is foldable out of its end-closing position. The side end closure flap is retained in its end-closing position by the handle flap. The handle flap is coupled to the proximal portion and separable from the distal glue flap such that the handle flap retains the side end closure flap in its end-closing position when the distal glue flap is folded out of its end-closing position.

Advantageously, the handle flap remains substantially coplanar, that is to say it separates from the distal glue flap, with the proximal portion and extends therefrom when the distal glue flap is folded out of its end closing position.

Optionally, the handle flap comprises a tongue forming a retention member for holding the side end closure flap in its end-closing position.

Optionally, the side end closure flap comprises a limb portion extending from a main body, wherein the handle flap is disposed in overlapping relationship with at least a part of the limb portion.

Optionally, the side end closure flap is coupled to the top end closure flap.

Optionally, the end closure structure comprises a web panel interconnecting the side end closure flap and the top end closure flap.

Optionally, the proximal portion is coupled to the side end closure flap.

Optionally, the end closure structure comprises a web panel interconnecting the proximal and the top end closure flap.

Optionally, the web panel is hingedly connected to the top end closure flap and is hingedly connected to the side end closure flap along a fold line, and wherein the web panel is separated from the side end closure flap by a disconnection element extending from the fold line such that the disconnection element defines an upper edge of a handle reinforcing portion of the side end closure flap for reinforcing the carrying handle.

Optionally, the disconnection element is formed from a feature selected from the group consisting of: a cutline, a severable line, a tear line, a slit, a slot, a notch and a cutout.

Optionally, the end closure structure comprises a second side end closure flap, the second side end closure flap is coupled to the other one of the first and second side walls and wherein the second side end closure flap is retained in its end-closing position by the handle flap.

Optionally, the end closure structure comprises a second web panel connecting the top end closure flap to the second side end closure flap. The second web panel is hingedly connected to the top end closure flap and is hingedly connected to the second side end closure flap along a further fold line, the second web panel is separated from the second side end closure flap by a second disconnection element extending from the further fold line such that the second disconnection element defines an upper edge of a handle reinforcing portion of the second side end closure flap for reinforcing the carrying handle.

Optionally, the handle reinforcing portion of the side end closure flap and the handle reinforcing portion of the second side end closure flap together extend along an engaging edge of the handle opening so as to reinforce the handle opening thereacross.

Optionally, the carton comprises a display window defined at least in the first side wall for display of at least one article.

Optionally, the display window is defined at least in part by a displaceable flap hingedly connected to the first side wall.

Optionally, the top wall is shorter in a longitudinal direction than the base wall.

Optionally, the top wall is shorter in a transverse direction than the base wall.

Optionally, the distal glue flap is hingedly connected to the proximal portion along a glue flap fold line, wherein the handle flap is hingedly connected to the proximal portion along a handle flap fold line and wherein the handle flap fold line is disposed at a higher elevation than the glue flap fold line.

Optionally, the end closure structure comprises a web panel interconnecting the side end closure flap and the proximal portion of the top end closure flap.

Optionally, the web panel is hingedly connected to the proximal portion along a web fold line such that a lower end of the web fold line is disposed proximate or above the glue flap fold line.

Optionally, the handle flap is connected to the proximal portion by at least one nick such that the at least one nick is intact when the distal glue flap is folded out of its end-closing position about the glue flap fold line.

Optionally, the at least one nick comprises two or more nicks and wherein the two or more nicks are disposed along opposite side edges of the handle flap.

A second aspect of the invention provides a blank for forming a carton. The blank comprises a plurality of panels for forming walls of a tubular structure, the plurality of panels including a top panel, a first side panel, a base panel, and a second side panel. The blank comprising panels for forming an end closure structure for at least partially closing an end of the tubular structure. The end closure structure comprises a top end closure flap having a handle flap which defines at least in part a handle opening in the top end closure flap for forming a carrying handle and a side end closure flap coupled to one of the first and second side walls. The side end closure flap comprises a portion which in a setup condition underlies the handle flap when both the top and side end flaps are folded into an end-closing position. The top end closure flap includes a proximal portion and a distal glue flap hingedly connected to the proximal portion. In a setup condition the distal glue flap is foldable out of its end-closing position and the side end closure flap is retained in its end-closing position by the handle flap. The handle flap is coupled to the proximal portion and is separable from the distal glue flap such that the handle flap retains the side end closure flap in its end-closing position when the distal glue flap is folded out of its end-closing position during an end closing process.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
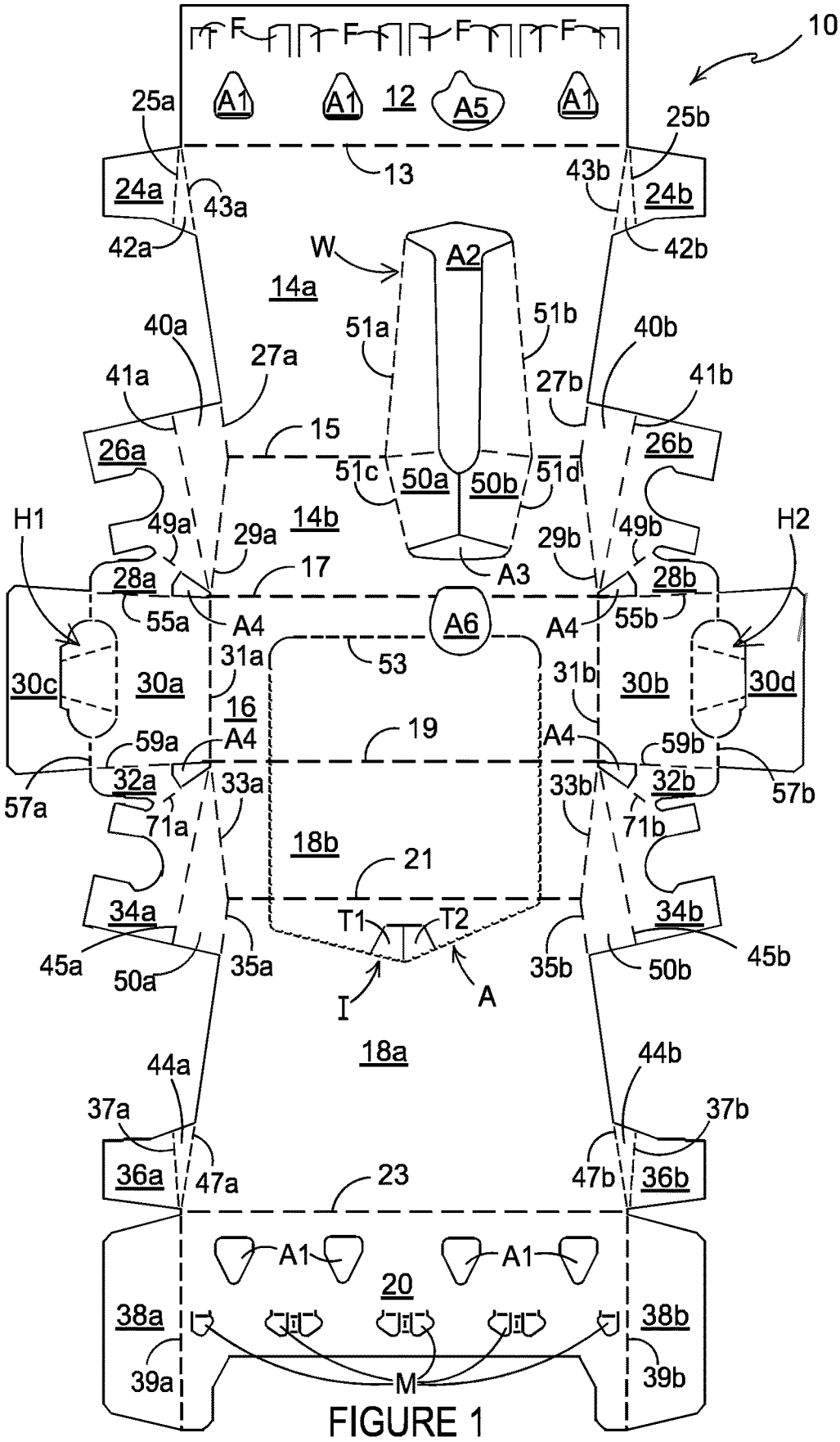
FIG. 1 is a plan view from above of a blank for forming a carton according to a first embodiment.
Figure 1A:
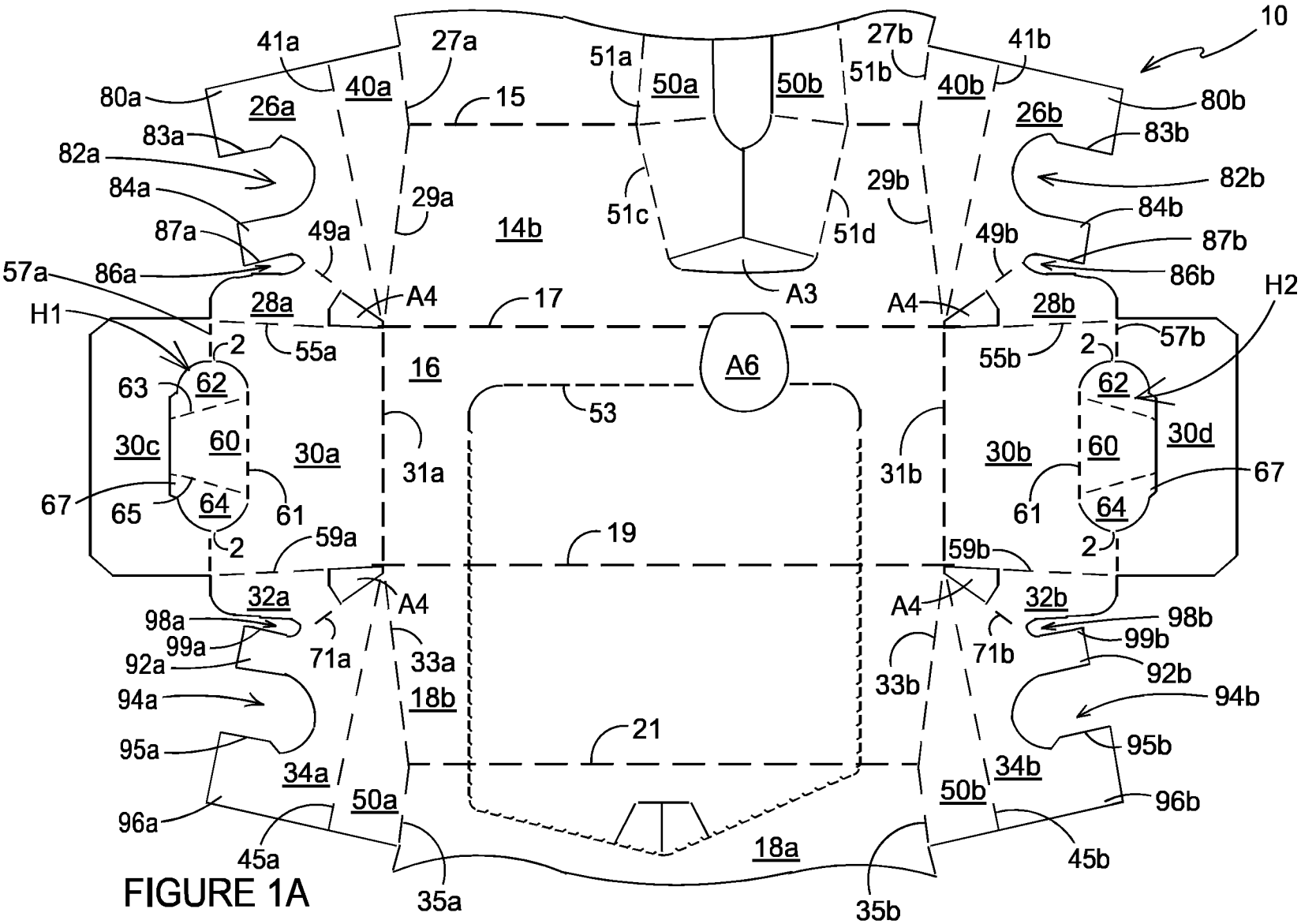
FIG. 1A is an enlarged plan view from above of a portion of the blank of FIG. 1.
Figure 2:
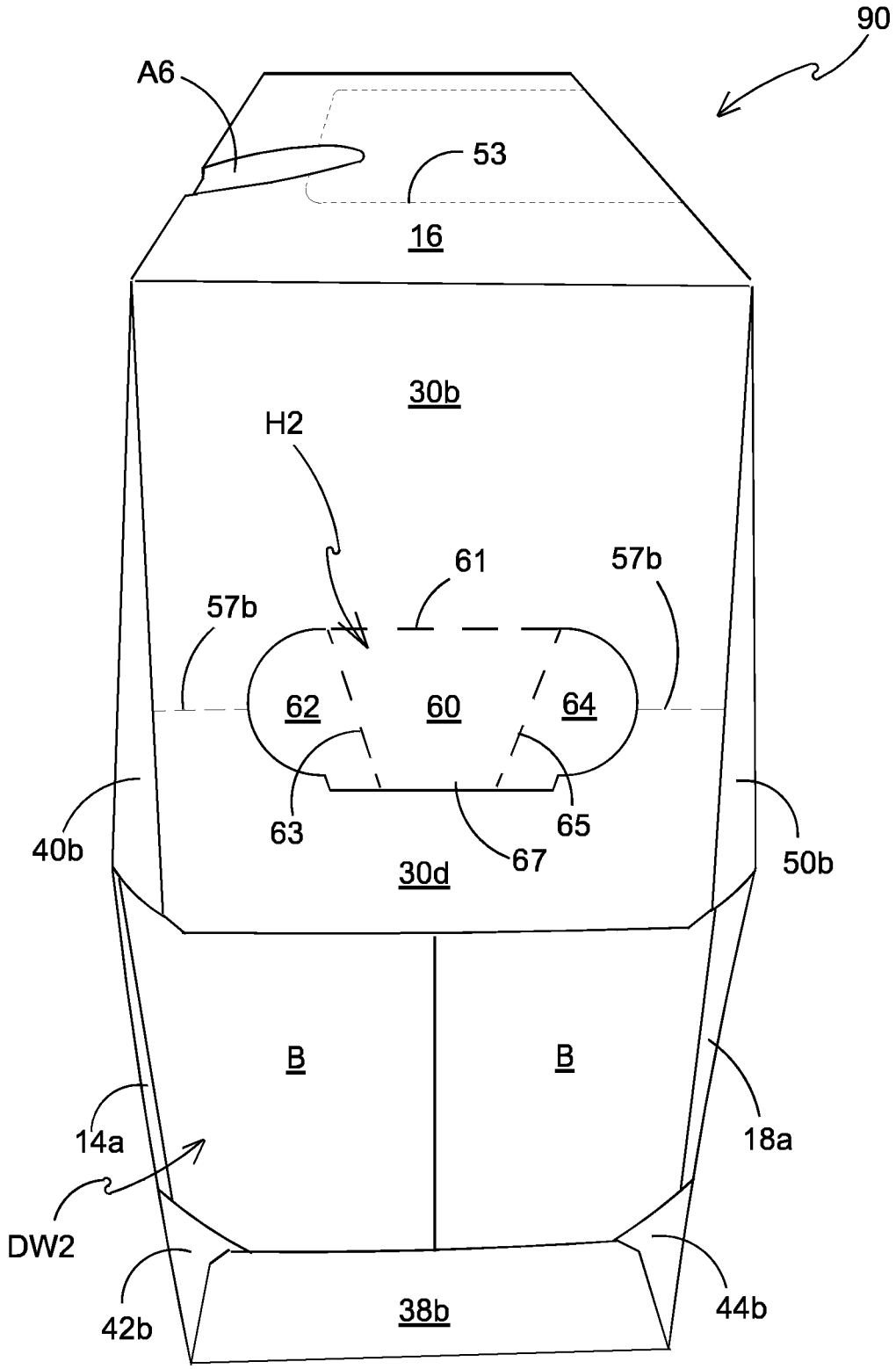
FIG. 2 is a perspective view from above of an end of a carton formed from the blank of FIG. 1.

Referring to FIG. 1 and to FIG. 1A, there is shown a plan view of a blank 10 capable of forming a carton or carrier 90, as shown in FIG. 2, for containing and carrying a group of primary products such as, but not limited to, bottles or cans, hereinafter referred to as articles B, as shown in FIG. 2. The blank 10 forms a secondary package for packaging at least one primary product container or package.

In the embodiments detailed herein, the terms "carton" and "carrier" refer, for the non-limiting purpose of illustrating the various features of the invention, to a container 90 for engaging and carrying articles B, such as primary product containers B. It is contemplated that the teachings of the invention can be applied to various product containers B, which may or may not be tapered and/or cylindrical. Exemplary containers include bottles B (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blank 10 is configured to form a carton or carrier 90 for packaging an exemplary arrangement of exemplary articles B. In the embodiment illustrated the arrangement is a 4×2 matrix or array; in the illustrated embodiment two rows of four articles B are provided, and the articles B are 16 oz (approx. 473 ml)

aluminium bottles. Alternatively, the blank 10 can be configured to form a carrier for packaging other types, number and size of articles B and/or for packaging articles B in a different arrangement or configuration.

The present disclosure relates generally to a carton 90 for packaging articles B which carton 90 comprises an article engaging arrangement for engaging an article B, however said article engaging arrangements is optional. The carton 90 may comprise at least one display window for presentation of an article B. The embodiments described herein may comprise a viewing window arrangement or display window W struck from a side wall 14*a*/14*b* of the carton 90. The display window W presents, for view a substantial portion of an article B contained within the carton 90, adjacent to that side wall 14*a*/14*b*. The embodiments described herein also disclose an optional viewing window arrangement or display window DW2 in at least one end wall.

Turning to FIG. 1, there is illustrated a blank 10 for forming a carton 90 according to a first embodiment. The blank 10 comprises a plurality of main panels 12, 14*a*, 14*b*, 16, 18*b*, 18*a*, 20 for forming a tubular structure. The plurality of main panels 12, 14*a*, 14*b*, 16, 18*b*, 18*a*, 20 comprises a first base panel 12, a first lower side panel 14*a*, a first upper side panel 14*b*, a top panel 16, a second upper side panel 18*b*, a second lower side panel 18*a* and a second base panel 20. The plurality of panels 12, 14*a*, 14*b*, 16, 18*b*, 18*a*, 20 may be arranged in a linear series hinged one to the next by corresponding fold lines 13, 15, 17, 19, 21, 23. The first upper side panel 14*b* and the first lower side panel 14*a* form a first side wall 14*a*/14*b* of a carton 90. The second upper side panel 18*b* and the second lower side panel 18*a* form a second side wall 18*a*/18*b* of a carton 90.

The blank 10 is foldable to form a package 90 as illustrated in FIG. 2. The first and second base panels 12, 20 are engageable with one another in an overlapping relationship to form a composite base wall 12/20 of the carton 90. The blank 10 may comprise a complementary locking mechanism for securing the second base panel 20 to the first base panel 12. The first base panel 12 may comprise at least one first part F of the complementary locking mechanism. The second base panel 20 may comprise at least one second part M of the complementary locking mechanism. In the illustrated embodiment, the first base panel 12 comprises a plurality of female tabs F defining openings in the first base panel 12. The second base panel 20 comprises a plurality of male tabs M, the openings in the first base panel 12 being configured to receive a respective one of the male tabs M. The female tabs F are arranged to be displaced out of the first base panel 12 to form the opening and to bear against the male tabs M when received therein.

The first and second base panels 12, 20 may comprise at least one first aperture A1. In the illustrated embodiment, each of the first and second base panels 12, 20 comprises four first apertures A1. The first apertures A1 may be employed to facilitate construction of the carton 90. A packaging machine component may engage with the first apertures A1 to enable the plurality of panels 12, 14*a*, 14*b*, 16, 18*b*, 18*a*, 20 to be tightened about a group of articles B. The first apertures A1 may also be employed to facilitate alignment of the first and second base panels 12, 20 with respect to each other or to align the first part of the complementary locking mechanism with the second part of the complementary locking mechanism. The complementary locking mechanism illustrated and described is entirely optional.

Optionally, the blank 10 comprises a first display window W formed in each of the first upper and first lower side walls 14*b*, 14*a*.

The first display window W comprises an opening in each of the first upper and first lower side walls or panels 14*b*, 14*a*. The opening is defined in part by: a first displaceable tab or flap 50*a*; in part by a second displaceable tab or flap 50*b*; in part by a second aperture A2 struck in part from the first upper side wall 14*b* and the first lower side wall 14*a*; and in part by a third aperture A3 struck from the first upper side wall 14*b*. The first and second displaceable flaps 50*a*, 50*b* are separated from each other in part by the second aperture A2 and in part by a severable line in the form of a cutline. The third aperture A3 defines upper edges of each of the first and second displaceable flaps 50*a*, 50*b*. The cutline extends between the second aperture A2 and the third aperture A3. The first and second displaceable flaps 50*a*, 50*b* are hinged to the first lower side panel 14*a* by fold lines 51*a*, 51*b* respectively. The first and second displaceable flaps 50*a*, 50*b* are hinged to the first upper side panel 14*b* by fold lines 51*c*, 51*d* respectively. The fold line 51*a* is contiguously arranged with the fold line 51*c* and the fold line 51*b* is convergently arranged with respect to the fold line 51*d*. The fold line 51*a* and the fold line 51*c* define a non-straight angle optionally, an oblique angle, therebetween. The fold line 51*b* is contiguously arranged with the fold line 51*d* and the fold line 51*b* is convergently arranged with respect to the fold line 51*d*. The fold line 51*b* and the fold line 51*d* define an oblique angle therebetween.

The first and second displaceable flaps 50*a*, 50*b* are hingedly connected to the first upper and first lower side walls 14*b*, 14*a* and are positioned opposite to one another.

In this way the fold lines 51*a*/51*c* and the fold lines 51*b*/51*d*, form non-linear hinged connections between a respective one of the displaceable tabs 50*a*, 50*b* and the first side wall 14*a*/14*b* as illustrated in the embodiment of FIG. 1. In other embodiments the fold lines may be curvilinear or arcuate or may be comprised of two or more linear portions arranged contiguously and divergently with respect to each other.

When the tabs 50*a*, 50*b* are displaced to display an article B as shown in FIG. 2, each of the non-linear hinged connections 51*a*/51*c*, 51*b*/51*d* increases or encourages the tendency of the respective displaceable tab 50*a*, 50*b* to return to its original, unfolded, planar position. In this way the tabs 50*a*, 50*b*, when displaced, are biased towards the article B displayed within the window W. The tabs 50*a*, 50*b* form a frame about the displayed article B and may at least partially separate the displayed article B from adjacent articles B in the row of articles B proximate the first side panel 14*a*/14*b*. The tabs 50*a*, 50*b* may at least partially conceal aforesaid adjacent articles B.

The blank 10 comprises at least one end closure structure for at least partially closing an end of a tubular structure defined by the plurality of panels 12, 14*a*, 14*b*, 16, 18*b*, 18*a*, 20.

In the illustrated embodiment an end closure structure is provided for at least partially closing each end of the tubular structure.

Each of the end closure structures may comprise or define a second display window DW2 (see FIG. 2) for the display of one or more articles B disposed adjacent thereto. In other embodiments, one of the second display windows DW2 may be omitted such that a display window is provided at only one end of the tubular structure; in still other embodiments both the second display windows DW2 may be omitted.

The blank 10 comprises a first end closure structure comprising a plurality of end closure panels 24*a*, 26*a*, 28*a*, 30*a*, 30*c*, 32*a*, 34*a*, 36*a*, 38*a*, 40*a*, 42*a*, 44*a*, 50*a*.

The first end closure structure comprises a first upper top end closure flap 30*a*, hingedly connected to the top panel 16 by a fold line 31*a*. A first lower top end closure flap 30*c* is hingedly connected to the first upper top end closure flap 30*a* by hinged connection in the form of a fold line 57*a*. The first upper top end closure flap 30*a* and the first lower top end closure flap 30*c* together form or define a first top end closure flap 30*a*/30*c*. The first upper top end closure flap 30*a* forms a proximal portion of the first top end closure flap 30*a*/30*c* disposed adjacent to the top panel 16. The first lower top end closure flap 30*c* forms a distal glue flap portion of the first top end closure flap 30*a*/30*c*.

The first end closure structure comprises a first upper side end closure flap 26*a* coupled to the first upper side panel 14*b*.

Optionally, a first web panel 28*a* is hingedly connected to the first upper top end closure flap 30*a* along a first side edge thereof by a hinged connection in the form of a fold line 55*a*. The first web panel 28*a* may be hingedly connected to the first upper side end closure flap 26*a* by a hinged connection in the form of a fold line 49*a*.

The first upper side end closure flap 26*a* may be coupled to the first upper side panel 14*b* by a first upper corner panel 40*a*.

Optionally, the first upper side end closure flap 26*a* is hingedly connected to the first upper corner panel 40*a* by a hinged connection in the form of a fold line 41*a*.

Optionally, the first upper corner panel 40*a* is hingedly connected to the first upper side panel 14*b* by a fold line 29*a*. The first upper corner panel 40*a* may be hingedly connected to the first lower side panel 14*a* by a fold line 27*a*. The fold line 27*a* and the fold line 29*a* define a non-straight angle, optionally an oblique angle, therebetween. The fold line 27*a* and the fold line 29*a* may converge to form a vertex which meets at a first end of fold line 15 between the first upper side panel 14*b* and the first lower side panel 14*a*.

An optional relief aperture A4 is provided proximate a first corner of the top panel 16. The first relief aperture A4 defines a portion of the first side edge of the first upper top end closure flap 30*a*, and forms a free side edge thereof. That is to say, said portion of the first side edge of the first upper top end closure flap 30*a* is not hinged to another panel. The relief aperture A4 spaces the first web panel 28*a* from the first corner of the top panel 16. The relief aperture A4 spaces apart the first upper top end closure flap 30*a* and the first upper side end closure flap 26*a*.

The first end closure structure may comprise a second upper side end closure flap 34*a* coupled to the second upper side panel 18*b*.

Optionally, a second web panel 32*a* is hingedly connected to the first upper top end closure flap 30*a* along a second side edge thereof by a hinged connection in the form of a fold line 59*a*. The second side edge of the first upper top end closure flap 30*a* opposes the first side edge of the first upper top end closure flap 30*a*.

The second web panel 32*a* may be hingedly connected to the second upper side end closure flap 34*a* by a hinged connection in the form of a fold line 71*a*.

The second upper side end closure flap 34*a* may be coupled to the second upper side panel 18*b* by a second upper corner panel 50*a*.

Optionally, the second upper side end closure flap 34*a* is hingedly connected to the second upper corner panel 50*a* by a hinged connection in the form of a fold line 45*a*.

Optionally, the second upper corner panel 50*a* is hingedly connected to the second upper side panel 18*b* by a fold line 33*a*. The second upper corner panel 50*a* may be hingedly connected to the second lower side panel 18*a* by a fold line 35*a*. The fold line 33*a* and the fold line 35*a* define a non-straight angle, optionally an oblique angle, therebetween. The fold line 33*a* and the fold line 35*a* may converge to form a vertex which meets at a first end of fold line 21 between the second upper side panel 18*b* and the second lower side panel 18*a*.

An optional relief aperture A4 is provided proximate a second corner of the top panel 16. The relief aperture A4 defines a portion of the second side edge of the first upper top end closure flap 30*a*, and forms a free side edge thereof. That is to say, said portion of the second side edge of the first upper top end closure flap 30*a* is not hinged to another panel. The relief aperture A4 spaces the second web panel 32*a* from the second corner of the top panel 16. The relief aperture A4 spaces apart the first upper top end closure flap 30*a* and the second upper side end closure flap 34*a*.

Optionally, the first end closure structure comprises a first lower side end closure flap 24*a* hingedly connected to a first gusset panel 42*a* by a hinged connection in the form of a fold line 25*a*. The first gusset panel 42*a* is hingedly connected to the first lower side panel 14*a* by a hinged connection in the form of a fold line 43*a*. Optionally, a second lower side end closure flap 36*a* is hinged to a second gusset panel 44*a* by a hinged connection in the form of a fold line 37*a*. The second gusset panel 44*a* is hingedly connected to the second lower side panel 18*a* by a hinged connection in the form of a fold line 47*a*. Optionally, a first bottom end closure flap 38*a* is hinged to the second base panel 20 by hinged connection in the form of a fold line 39*a*. The first lower side end closure flap 24*a*, first gusset panel 42*a*, second lower side end closure flap 36*a*, second gusset panel 44*a* and first bottom end closure flap 38*a* are arranged to partially close a lower region of an open end of the tubular structure.

The blank 10 comprises a second end closure structure comprising a plurality of end closure panels 24*b*, 26*b*, 28*b*, 30*b*, 30*d*, 32*b*, 34*b*, 36*b*, 38*b*, 40*b*, 42*b*, 44*b*, 50*b*.

The second end closure structure comprises a second upper top end closure flap 30*b*, hingedly connected to the top panel 16 by a fold line 31*b*. A second lower top end closure flap 30*d* is hingedly connected to the second upper top end closure flap 30*b* by hinged connection in the form of a fold line 57*b*. The second upper top end closure flap 30*b* and the second lower top end closure flap 30*d* together form or define a second top end closure flap 30*b*/30*d*. The second upper top end closure flap 30*b* forms a proximal portion of the second top end closure flap 30*d*/30*d* disposed adjacent to the top panel 16. The second lower top end closure flap 30*d* forms a distal glue flap portion of the second top end closure flap 30*b*/30*b*.

The second end closure structure comprises a third upper side end closure flap 26*b* coupled to the first upper side panel 14*b*.

Optionally, a third web panel 28*b* is hingedly connected to the second upper top end closure flap 30*b* along a first side edge thereof by a hinged connection in the form of a fold line 55*b*.

The third web panel 28*b* may be hingedly connected to the third upper side end closure flap 26*b* by a hinged connection in the form of a fold line 49*b*.

The third upper side end closure flap 26*b* may be coupled to the first upper side panel 14*b* by a third upper corner panel 40*b*.

Optionally, the third upper side end closure flap 26*b* is hingedly connected to the third upper corner panel 40*b* by a hinged connection in the form of a fold line 41*b*.

Optionally, the third upper corner panel 40*b* is hingedly connected to the first upper side panel 14*b* by a fold line 29*b*. The third upper corner panel 40*b* may be hingedly connected to the first lower side panel 14*a* by a fold line 27*b*. The fold line 27*b* and the fold line 29*b* define a non-straight angle, optionally an oblique angle, therebetween. The fold line 27*b* and the fold line 29*b* may converge to form a vertex which meets at a second end of fold line 15 between the first upper side panel 14*b* and the first lower side panel 14*a*.

An optional relief aperture A4 is provided proximate a third corner of the top panel 16. The relief aperture A4 defines a portion of the first side edge of the second upper top end closure flap 30*b*, and forms a free side edge thereof. That is to say, said portion of the first side edge of the second upper top end closure flap 30*b* is not hinged to another panel. The relief aperture A4 spaces the third web panel 28*b* from the third corner of the top panel 16. The relief aperture A4 spaces apart the third upper top end closure flap 30*b* and the third upper side end closure flap 26*b*.

The second end closure structure may comprise a fourth upper side end closure flap 34*b* coupled to the second upper side panel 18*b*.

Optionally, a fourth web panel 32*b* is hingedly connected to the second upper top end closure flap 30*b* along a second side edge thereof by a hinged connection in the form of a fold line 59*b*. The second side edge of the second upper top end closure flap 30*b* opposes the first side edge of the second upper top end closure flap 30*b*.

The fourth web panel 32*b* may be hingedly connected to the fourth upper side end closure flap 34*b* by a hinged connection in the form of a fold line 71*b*.

The fourth upper side end closure flap 34*b* may be coupled to the second upper side panel 18*b* by a fourth upper corner panel 50*b*.

Optionally, the fourth upper side end closure flap 34*b* is hingedly connected to the fourth upper corner panel 50*b* by a hinged connection in the form of a fold line 45*b*.

Optionally, the fourth upper corner panel 50*b* is hingedly connected to the second upper side panel 18*b* by a fold line 33*b*. The fourth upper corner panel 50*b* may be hingedly connected to the second lower side panel 18*a* by a fold line 35*b*. The fold line 33*a* and the fold line 35*b* define a non-straight angle, optionally an oblique angle, therebetween. The fold line 33*b* and the fold line 35*b* may converge to form a vertex which meets at a second end of fold line 21 between the second upper side panel 18*b* and the second lower side panel 18*a*.

An optional relief aperture A4 is provided proximate a fourth corner of the top panel 16. The relief aperture A4 defines a portion of the second side edge of the second upper top end closure flap 30*b*, and forms a free side edge thereof. That is to say, said portion of the second side edge of the second upper top end closure flap 30*b* is not hinged to another panel. The relief aperture A4 spaces the fourth web panel 32*b* from the fourth corner of the top panel 16. The relief aperture A4 spaces apart the second upper top end closure flap 30*b* and the fourth upper side end closure flap 34*b*.

Optionally, the second end closure structure comprises a third lower side end closure flap 24*b* hingedly connected to a third gusset panel 42*b* by a hinged connection in the form of a fold line 25*b*. The third gusset panel 42*b* is hingedly connected to the first lower side panel 14*a* by a hinged connection in the form of a fold line 43*b*. Optionally, a fourth lower side end closure flap 36*b* is hinged to a fourth gusset panel 44*b* by a hinged connection in the form of a fold line 37*b*. The fourth gusset panel 44*b* is hingedly connected to the second lower side panel 18*a* by a hinged connection in the form of a fold line 47*b*. Optionally, a second bottom end closure flap 38*b* is hinged to the second base panel 20, along a second end edge thereof, by hinged connection in the form of a fold line 39*b*. The third lower side end closure flap 24*b*, third gusset panel 42*b*, fourth lower side end closure flap 36*b*, fourth gusset panel 44*b* and second bottom end closure flap 38*b* are arranged to partially close a lower region of an open end of the tubular structure.

Referring now to FIG. 1A, the first upper side end closure flap 26*a* comprises a main body portion and upper and lower limb portions 84*a*, 80*a* extending therefrom. The upper and lower limb portions 84*a*, 80*a* define a recess or cutaway 82*a* therebetween.

The upper limb portion 84*a* is separated from the first web panel 28*a* (when present) by a separation or disconnection element 86*a*, the disconnection element has the effect of freeing the upper limb portion 84*a* from connection to the first web panel 28*a*. The main body portion of first upper side end closure flap 26*a* is hingedly connected at an upper end thereof to the first web panel 28*a* by the fold line 49*a*. The disconnection element 86*a* defines an upper free edge 87*a* of the upper limb portion 84*a* and a lower free edge of the first web panel 28*a*. The disconnection element 86*a* takes the form of a recess or cutaway, for example a slot or slit.

The lower limb portion 80*a* comprises a projection or lobe extending toward or into the recess or cutaway 82*a*. The projection or lobe defines at least in part an upper free edge 83*a* of the lower limb portion 80*a*.

The second upper side end closure flap 34*a*, when provided, comprises a main body portion and upper and lower limb portions 92*a*, 96*a* extending therefrom. The upper and lower limb portions 92*a*, 96*a* define a recess or cutaway 94*a* therebetween.

The upper limb portion 92*a* is separated from the second web panel 32*a* by a separation or disconnection element 98*a*, the disconnection element 98*a* has the effect of freeing the upper limb portion 92*a* from connection to the second web panel 32*a*. The main body portion of the second upper side end closure flap 34*a* is hingedly connected at an upper end thereof to the second web panel 32*a* by the fold line 71*a*. The disconnection element 98*a* defines an upper free edge 99*a* of the upper limb portion 92*a* and a lower free edge of the second web panel 32*a*. The disconnection element 98*a* takes the form of a recess or cutaway, for example a slot or slit.

The lower limb portion 96*a* comprises a projection or lobe extending toward or into the recess or cutaway 94*a*. The projection or lobe defines at least in part an upper free edge 95*a* of the lower limb portion 96*a*.

The third upper side end closure flap 26*b*, when provided, comprises a main body portion and upper and lower limb portions 84*b*, 80*b* extending therefrom. The upper and lower limb portions 84*b*, 80*b* define a recess or cutaway 82*b* therebetween.

The upper limb portion 84*b* is separated from the third web panel 28*b* by a separation or disconnection element 86*b*, the disconnection element has the effect of freeing the upper limb portion 84*b* from connection to the third web panel 28*b*. The main body portion of third upper side end closure flap 26*b* is hingedly connected at an upper end thereof to the third web panel 28*b* by the fold line 49*b*. The disconnection element 86*b* defines an upper free edge 87*b* of the upper limb portion 84*b* and a lower free edge of the third web panel

28*b*. The disconnection element 86*a* takes the form of a recess or cutaway for example a slot or slit.

The lower limb portion 80*b* comprises a projection or lobe extending toward or into the recess or cutaway 82*b*. The projection or lobe defines at least in part an upper free edge 83*b* of the lower limb portion 80*b*.

The fourth upper side end closure flap 34*b*, when provided, comprises a main body portion and upper and lower limb portions 92*b*, 96*b* extending therefrom. The upper and lower limb portions 92*b*, 96*b* define a recess or cutaway 94*b* therebetween.

The upper limb portion 92*b* is separated from the fourth web panel 32*b* by a separation or disconnection element 98*b*. The disconnection element 98*b* has the effect of freeing the upper limb portion 92*b* from connection to the second web panel 32*b*. The main body portion of fourth upper side end closure flap 34*b* is hingedly connected at an upper end thereof to the fourth web panel 32*b* by the fold line 71*b*. The disconnection element 98*b* defines an upper free edge 99*b* of the upper limb portion 92*b* and a lower free edge of the fourth web panel 32*b*. The disconnection element 98*b* takes the form of a recess or cutaway, for example a slot or slit.

The lower limb portion 96*b* comprises a projection or lobe extending toward or into the recess or cutaway 94*b*. The projection or lobe defines at least in part an upper free edge 95*b* of the lower limb portion 96*b*.

The blank 10 comprises a carrying handle structure H1, H2 in each of the first and second top end closure flaps 30*a*/30*c*, 30*b*/30*d* respectively. The carrying handle structures H1, H2 may be employed by a user to carry the carton 90. The first top end closure flap 30*a* comprises a carrying handle structure H1 having a handle opening defined at least in part by a handle flap 60 struck, at least in part, from the first top end closure flap 30*a*. The handle flap 60 is hinged to the first top end closure flap 30*a* by a hinged connection in the form of a fold line 61. The handle flap 60 comprises a pair of fold lines 63, 65 extending from the fold line 61 to an opposing side edge of the handle flap 60 so as to define a pair of foldable end portions 62, 64.

The pair of fold lines 63, 65 are arranged so as to diverge towards the fold line 61. The handle flap 60, including the end portions 62, 64 is struck in part from the first upper top end closure flap 30*a* and in part from the first lower top end closure flap 30*c*. In this way the handle flap 60 and therefore the handle opening interrupt the fold line 57*a* hinging the first lower top end closure flap 30*c* to the first upper top end closure flap 30*a*.

Optionally, the handle flap 60 comprises a tongue 67 extending from, and defining, a portion of the opposing side edge. The tongue 67 defines a recessed or cutaway portion 69 (see FIG. 3) of the handle opening.

The first lower top end closure flap 30*c* or distal glue flap may be hingedly connected to the first upper top end closure flap 30*a* or proximal portion of the first top end closure flap 30*a*/30*c* along a glue flap fold line. The handle flap 60 may be hingedly connected to the first upper top end closure flap 30*a* along a handle flap fold line—fold line 61 in FIG. 1A. The handle flap fold line 61 may be disposed at a higher elevation than a glue flap fold line—fold line 57*a*. In other words the handle flap fold line 61 may be disposed closer to fold line 31*a* (connecting the first upper top end closure flap 30*a* to the top panel 16) than the glue flap fold line 57*a*.

The web panel 28*a* may interconnect the first side end closure flap 26*a* and first upper top end closure flap 30*a* or proximal portion of the first top end closure flap 30*a*/30*c*. The web panel 32*a* may interconnect the second side end closure flap 34*a* and first upper top end closure flap 30*a* or proximal portion of the first top end closure flap 30*a*/30*c*.

The web panel 28*a* may be hingedly connected to the first upper top end closure flap 30*a* or proximal portion of the first top end closure flap 30*a*/30*c* along a first web fold line—fold line 55*a*—such that a lower end of the first web fold line 55*a* is disposed proximate or above the glue flap fold line 57*a*.

The web panel 32*a* may be hingedly connected to the first upper top end closure flap 30*a* or proximal portion of the first top end closure flap 30*a*/30*c* along a second web fold line—fold line 59*a*—such that a lower end of the second web fold line 59*a* is disposed proximate or above the glue flap fold line 57*a*.

The handle flap 60 may be coupled to the first upper top end closure flap 30*a* or proximal portion and be separate or separable from the distal glue flap.

The handle flap 60 may be severably connected or coupled to the first upper top end closure flap 30*a* or the proximal portion by at least one nick 2 such that the at least one nick 2 is intact when the first lower top end closure flap 30*c* or distal glue flap is folded out of an end-closing position about the glue flap fold line 57*a*.

The handle structure may comprise two or more nicks 2 which are disposed along opposite side edges of the handle flap 60.

The second top end closure flap 30*b* comprises a carrying handle structure H2 which is substantially the same in construction as the first carrying handle structure H1 and will not be described in further detail.

Optionally, the blank 10 comprises a dispensing or access feature A (see FIG. 1) for facilitating access to the contents of the carton 90. The access feature A comprises an access panel struck in part from the top panel 16, in part from the second upper side panel 18*b*, and in part from the second lower side panel 18*a*. The access panel A is defined by a weakened line of severance 53 formed as a continuous loop such that the access panel A is at least partially severable from the carton 90. The access feature A may comprise a tear initiation feature I comprising a pair of tabs T1, T2 hingedly connected to the second lower side panel 18*a* by respective fold lines and defined by a cutline interrupted by connecting portions or nicks so as to be readily severable. The tear initiation feature I defines a finger opening to enable engagement with the access panel A for removal thereof.

The first corner panel 40*a* comprises a first lower free end edge. The second corner panel 50*a* comprises a second lower free end edge. The third corner panel 40*b* comprises a third lower free end edge. The fourth corner panel 50*b* comprises a fourth lower free end edge.

The first corner panel 40*a* terminates at the first lower free end edge. The first lower free end edge is distal from the first lower side end closure flap 24*a*, such that the first lower side panel 14*a* comprises a first free edge portion. That is to say, a portion of a first side edge of the first lower side panel 14*a* is free from any hinged connection to the panels of the first side end closure structure.

The second lower corner panel 50*a* terminates at the second lower free end edge. The second lower free end edge is distal from the second lower side end closure flap 36*a*, such that the second lower side panel 18*a* comprises a first free edge portion. That is to say, a portion of a first side edge of the second lower side panel 18*a* is free from any hinged connection to the panels of the second side end closure structure.

The third corner panel 40*b* terminates at the third lower free end edge. The third lower free end edge is distal from the third lower side end closure flap 24*b*, such that the first lower side panel 14*a* comprises a second free edge portion, that is to say a portion of a second side edge of the first lower side panel 14*a* is free from any hinged connection to the panels of the first side end closure structure.

The fourth lower corner panel 50*b* terminates at the fourth lower free end edge. The fourth lower free end edge is distal from the fourth lower side end closure flap 36*b*, such that the second lower side panel 18*a* comprises a second free edge portion. That is to say, a portion of a second side edge of the second lower side panel 18*a* is free from any hinged connection to the panels of the second side end closure structure.

The top panel 16 comprises a first length dimension extending between fold lines 31*a*, 31*b*. The first and second base panels 12, 20 comprise a second length dimension extending between free end edges of the first base panel 12 or between fold lines 39*a*, 39*b*. The second length dimension may be greater than the first length dimension.

The top panel 16 comprises a first width dimension extending between fold lines 17, 19. The second base panel 20 comprises a second width dimension. The second width dimension may be greater than the first width dimension. In some embodiments, the second width dimension may be defined by both the first and second base panels 12, 20, and may be equivalent to the sum of the widths of the first and second base panels 12, 20 minus the width of a region of overlap between the first and second base panels 12, 20.

Returning to FIG. 1, the blank 10 may comprise an orientation adjustment device for enabling adjustment of the orientation of an article B.

The orientation adjustment device is arranged such that the article B displayed in the first display window W in the first side wall 14*a*/14*b* can be controlled or adjusted. It will be appreciated that the orientation adjustment device may be located such that one or both articles B presented in one or both of the second display windows DW2 in the end walls of the carton 90 can also be controlled or adjusted.

The orientation adjustment device comprises first cutaway or opening in the form of a lower aperture A5 provided in at least one of the first and second base panels 12, 20. In the illustrated embodiment the lower aperture A5 is provided in the first base panel 12.

In other embodiments the lower aperture A5 may be provided in the second base panel 20 or in part in each of the first and second base panels 12, 20.

The lower aperture A5 is arranged to be in vertical registry with the article B which is disposed in the first display window W.

In the illustrated embodiment, the lower aperture A5 is arranged to be vertically aligned substantially with the first display window W.

The lower aperture A5 may be shaped so as to comprise a "V" or "U" shaped cutaway portion which provides an alignment or assembly guide. This cutaway portion may be engaged by a tool (not shown), for example of a packaging machine. The cutaway portion may facilitate alignment of the first base panel 12 with the second base panel 20 when the carton 90 is assembled about a group of articles B. Additionally or alternatively the cutaway portion may facilitate tightening or wrapping of the carton 90 about the group of articles B. It may facilitate pulling the first base panel 12 towards the second side panel 18*a*/18*b* so as to increase the degree of overlap between the first and second base panels 12, 20 such that the complementary locking mechanism may be employed.

The orientation adjustment device comprises a second cutaway or opening in the form of an upper aperture A6 provided at least in part in the top panel 16. In the embodiment of FIG. 1 the upper aperture A6 is provided in part in the top panel 16 and in part in the first upper side panel 14*b*. Extending the aperture A6 into the first upper side panel 14*b* may facilitate folding the top panel 16 with respect to the first upper side panel 14*b* along the fold line 17.

In other embodiments, the upper aperture A6 may be provided solely in the top panel 16, so as to be struck from only material that would otherwise have formed the top panel 16. Such an arrangement may be advantageous when the article B is returned or lowered to a rest position within the interior chamber of the carton 90.

In such alternative embodiments, a front or outer edge of the upper aperture A6 is provided by the top panel 16 and therefore is oriented horizontally or perpendicularly with respect to a direction of travel of the article B as it moves, or descends, into the carton 90. This may reduce the likelihood of a portion of the article B, such as a flange or cap or other closure, from being caught or snagged upon material defining an edge of the upper aperture A6.

The upper aperture A6 is arranged to be in vertical registry with the upper end of the article B which is disposed in the display window W. The upper aperture A6 is dimensioned such that an upper portion of said article B can pass through the top panel 16.

The upper aperture A6 is arranged to be vertically aligned with the first display window W.

The upper aperture A6 may be dimensioned so as to be smaller than a shoulder portion of the article B. In this way an upper end portion of the article B may pass through the upper aperture A6 but is prevented from being fully withdrawn through the upper aperture A6. When the article B is a bottle, the "finish" F, and at least some of the "neck" N, may be positioned externally of the carton 90. The "shoulder" S, "body" and "heel" of the bottle, being retainable within the carton 90.

In embodiments having a dispensing or access feature A the upper aperture A6 may interrupt the weakened line of severance 53. The upper aperture A6 may serve to facilitate removal of the access panel A.

The first display window W defines a notional centre axis perpendicular to the fold lines 13, 15, 17, 19, 21, 23, which hingedly connect the plurality of panels 12, 14*a*, 14*b*, 16, 18*b*, 18*a*, 20 in series. The blank 10 is arranged such that the upper aperture A6 is aligned with the first display window W along the notional centre axis.

Turning to the construction of the carton 90 as illustrated in FIG. 2, the carton 90 can be formed by a series of sequential folding operations. The folding process is not limited to that described below and may be altered according to particular manufacturing requirements.

A group of articles B is assembled; in the preferred embodiment eight articles B are arranged in a 4×2 array. The top panel 16 of the blank 10 is disposed above the group of articles B to provide a top wall 16 of the carton 90.

The window panels 50*a*, 50*b* (when present) are folded inwardly of the carton 90 either prior to or simultaneously with the first and second side walls 14*a*/14*b*, 18*a*/18*b* being folded about the fold lines 17, 19 so as to be disposed on opposing sides of the group of articles B. The window panels 50*a*, 50*b* are disposed such that they are interposed between a pair of adjacent articles B. Folding the window panels 50*a*, 50*b* in this manner warps the corresponding one of the first or second side walls 14*a*/14*b*, 18*a*/18*b* to which they are attached due to the non-linear nature of the fold lines 51*a*,

51*b*, 51*c*, 51*d* connecting the window panels 50*a*, 50*a* to the first side wall 14*a*/14*b*. The warping of the first side wall 14*a*/14*b* urges the window panels 50*a*, 50*b* against the article B.

Once the first and second sidewalls 14*a*/14*b*, 18*a*/18*b* are folded about the opposing sides of the group of articles B; the first base panel 12 is folded about the fold line 13 so as to be disposed adjacent the base of the group of articles B. The second base panel 20 is then folded about the fold line 23 so as to be in at least partial overlapping relationship with the first base panel 12. The first and second base panels 12, 20 are secured together. Each of the male tabs M is displaced inwardly out of the plane of the second base panel 20. In so doing, each of the female tabs F is displaced inwardly creating a corresponding opening in the first base panel. The male tabs M are received in respective ones of the openings so as to lock the first and second base panels 12, 20 together. In this way a tubular structure is formed about the group of articles B.

In some embodiments, the blank 10 may be formed into a tubular structure and subsequently loaded with articles B through at least one open end thereof.

Figure 3:
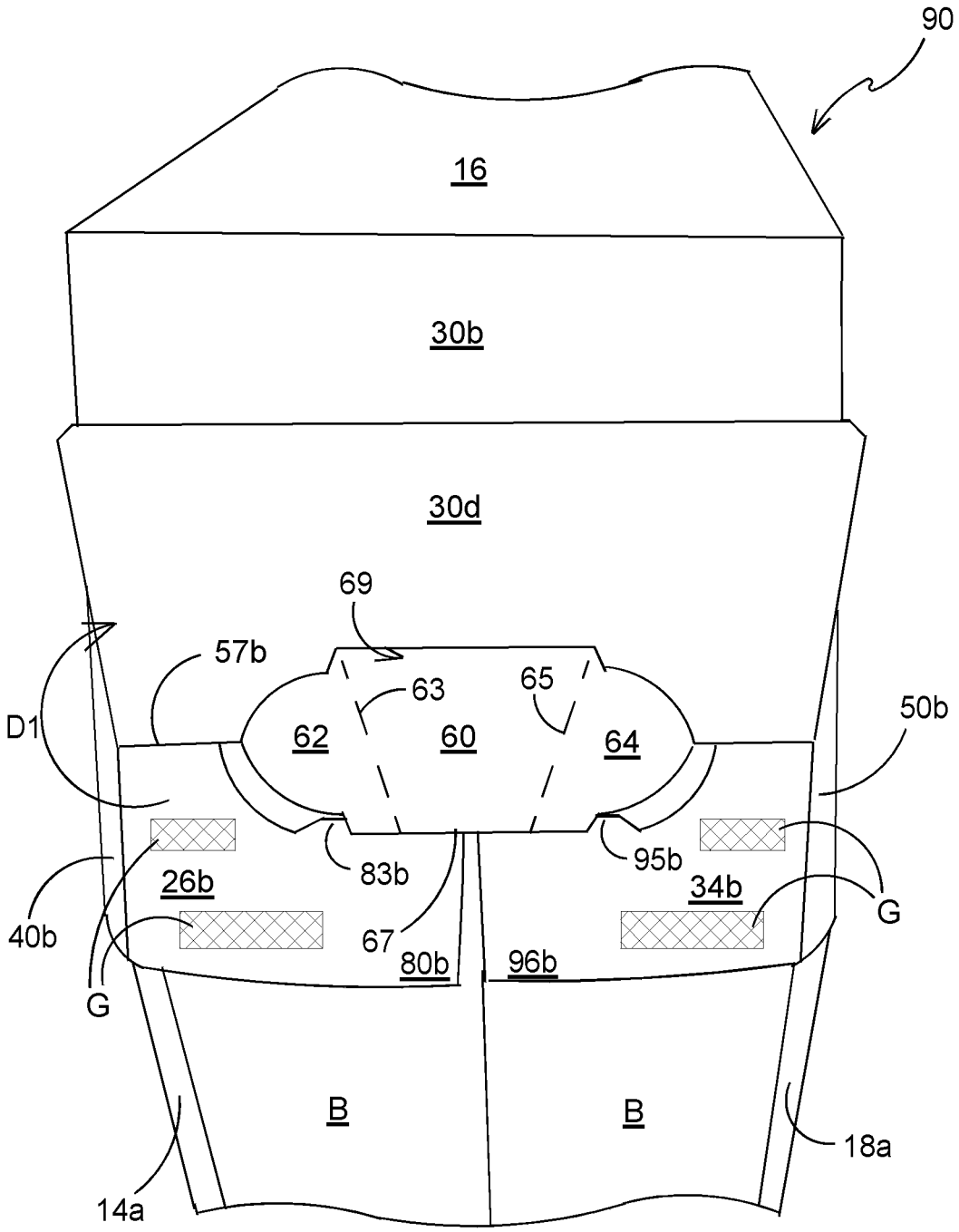
FIG. 3 is a further perspective view of the carton of FIG. 2 illustrating a stage of assembly of an end closure structure.

The first and second end closure structures are folded about the open ends of the tubular structure. The folding sequence for each of the first and second end closure structures is substantially the same and will be described in more detail by reference to the second end closure structure only as illustrated in FIGS. 2 and 3.

The third and fourth upper side end closure flaps 26*b*, 34*b* and the third and fourth corner panels 40*b*, 50*b* (when present) are folded about the fold lines 27*b*, 29*b*, 41*b*, 33*b*, 35*b*, 45*b* so as to partially close the second open end of the tubular structure.

As a consequence of folding third and fourth upper side end closure flaps 26*b*, 34*b* and the third and fourth corner panels 40*b*, 50*b* inwardly about the fold lines 27*b*, 29*b*,41*b*, 33*b*, 35*b*, 45*b* the second top end closure flap 30*b*,30*d* is folded downwardly.

The disconnection elements 86*b*, 98*b* facilitate folding of the end closure structure. In embodiments in which the disconnection elements 86*b*, 98*b* take the form of slot or recess the disconnection elements 86*b*, 98*b* increase the clearance between the third upper side end closure flap 26*b* and the third web panel 28*b* and between the fourth upper side end closure flap 34*b* and the fourth web panel 32*b*, so as to mitigate against collision therebetween.

The third and fourth upper side end closure flaps 26*b*, 34*b* are folded inwardly so as to be brought into close proximity or contact with the endmost articles B in the carton 90. The third web panel 28*b* and the fourth web panel 32*b* are folded into face to face relationship with the respective one of third and fourth upper side end closure flaps 26*b*, 34*b*, such that a first surface each of the third and fourth web panels 28*b*, 32*b* faces a first surface of the respective one of the third and fourth upper side end closure flaps 26*b*, 34*b*.

It will be appreciated that the sheet material comprises a first surface and a second surface. The first surface may be a coated, printed or otherwise finished surface. The second surface may be an uncoated surface typically referred to in the art as a "brown side". The folding arrangement is such that the disposition of the respective one of the first and second surfaces of the sheet material provided by the third and fourth web panels 28*b*, 32*b* is reversed in orientation with respect to the first and second surfaces of the sheet material provided by the top end closure panel 30*b*, 30*d*, third and fourth upper side end closure flaps 26*b*, 34*b* and third and fourth corner panels 40*b*, 50*b*. In other words the coated, printed or otherwise finished surface of the top end closure panel 30*b*, 30*d*, third and fourth upper side end closure flaps 26*b*, 34*b* and third and fourth corner panels 40*b*, 50*b* faces outwardly of the interior of the carton 90 whereas the brown side of third and fourth web panels 28*b*, 32*b* faces outwardly of the interior of the carton 90.

The second upper top end closure flap 30*b* is folded downwardly such that a second surface thereof is brought into close proximity or contact and faces a second surface of the respective one of third and fourth upper side end closure flaps 26*b*, 34*b*.

The third and fourth web panels 28*b*, 32*b* are disposed between the second upper top end closure flap 30*b* and the respective one of third and fourth upper side end closure flaps 26*b*, 34*b* to which they are hingedly connected.

The upper limb 84*b* of the third upper side end closure flap 26*b* and the upper limb 92*b* of the fourth upper side end closure flap 34*b* each extend across the end of the tubular structure. The upper limb 84*b* of the third upper side end closure flap 26*b* and the upper limb 92*b* of the fourth upper side end closure flap 34*b* each provide a reinforcing ply of material forming a handle reinforcing member.

The upper edge 87*b* of the upper limb 84*b* of the third upper side end closure flap 26*b* and the fold line 49*b* define an angle therebetween. The angle is a non-straight angle, that is to say less than 180°, in some embodiments the angle is an obtuse angle.

The upper edge 99*b* of the upper limb 92*b* of the fourth upper side end closure flap 34*b* and the fold line 71*b* define an angle therebetween. The angle is a non-straight angle, that is to say less than 180°, in some embodiments the angle is an obtuse angle.

The second top end closure flap 30*b*/30*d* is secured to the third and fourth upper side end closure flaps 26*b*, 34*b*.

The second lower top end closure flap 30*d* is folded upwardly—out of, or away from, an end closing position—with respect to the second upper top end closure flap 30*b* about the fold line 57*b* as illustrated in FIG. 3. In this way the lower limb portions 80*b*, 96*b* of the third and fourth upper side end closure flaps 26*b*, 34*b* and adjacent portions of the main body of each of the third and fourth upper side end closure flaps 26*b*, 34*b* are exposed.

The tongue 67 of the handle flap 60 serves as a retention member, holding each of the third and fourth upper side end closure flaps 26*b*, 34*b* in their folded positions as shown in FIG. 3. The tongue 67 of the handle flap 60 is disposed in overlying or overlapping relationship with the third and fourth upper side end closure flaps 26*b*, 34*b*.

The tongue 67 engages with the projection or lobe of the third and fourth upper side end closure flaps 26*b*, 34*b*.

Glue G or other adhesive treatment may be applied to the outer surface of the lower limb portions 80*b*, 96*b* of the third and fourth upper side end closure flaps 26*b*, 34*b* and/or to the outer surface of said adjacent portions of the main body of each of the third and fourth upper side end closure flaps 26*b*, 34*b* as shown in FIG. 3. Alternatively glue or other adhesive treatment may be applied to the inner surface of the second lower top end closure flap 30*d*.

The second lower top end closure flap 30*d* is folded downwardly—in to, or towards, an end closing position—with respect to the second upper top end closure flap 30*b* about the fold line 57*b* and is brought into face contacting relationship with the lower limb portions 80*b*, 96*b* and said adjacent portions of the main body of each of the third and fourth upper side end closure flaps 26*b*, 34*b* so as to secure them together.

The third and fourth lower side end closure flaps 24*b*, 36*b* along with the third and fourth gusset panels 42*b*, 44*b*, when present, are folded about the fold lines 25*b*, 37*b*, 43*b*, 47*b*. The third lower side end closure flap 24*b* may be secured to the fourth lower side end closure flap 36*b*. In some embodiments the third and fourth lower side end closure flaps 24*b*, 36*b* may be dimensioned so as to be arranged in an at least partial overlapping arrangement. Glue or other adhesive treatment may be applied to one of the third and fourth lower side end closure flaps 24*b*, 36*b* so as to secure them together.

Glue or other adhesive treatment may be applied to the third and fourth lower side end closure flaps 24*b*, 36*b* or to the second bottom end closure flap 38*b*.

The second bottom end closure flap 38*b* is folded about fold line 39*b* so as to be brought up into face contacting relationship with the third and fourth lower side end closure flaps 24*b*, 36*b*.

The second bottom end closure flap 38*b* is secured to the third and fourth lower side end closure flaps 24*b*, 36*b*.

The assembled carton 90 is shown in FIG. 2.

Figure 4:
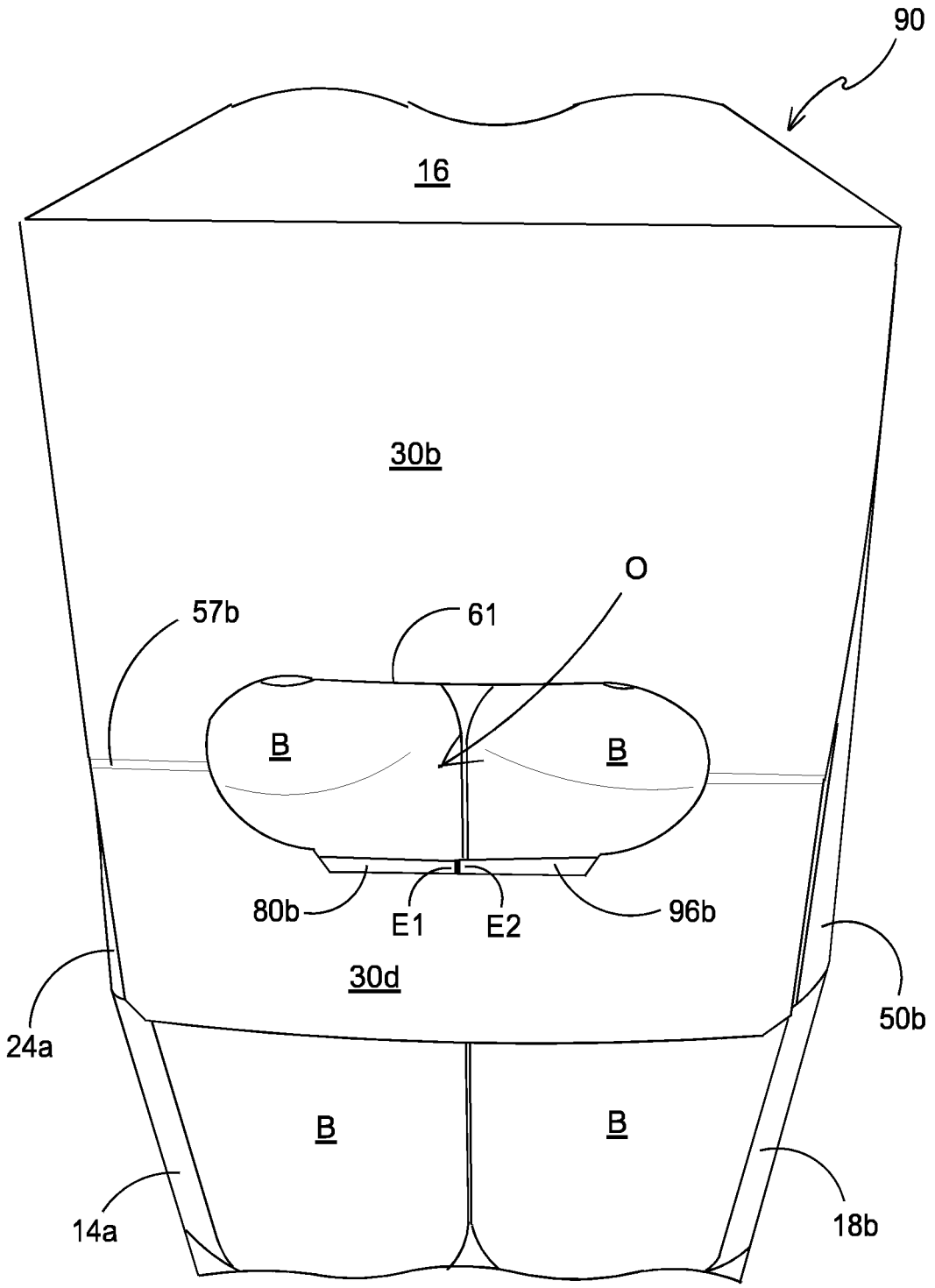
FIG. 4 is a perspective view from above of an end of the carton of FIG. 2 in which a handle structure has been deployed as a carrying handle.

FIG. 4 illustrates the handle structure of the carton 90 in a deployed condition. The handle flap has been folded inwardly of the carton 90. FIG. 4 shows that the lower limbs 80*b*, 96*b* are arranged such that an end edge E1 of the lower limb 80*b* abuts an end edge E2 of the lower limb 96*b*.

Referring now to FIGS. 5 to 10, there is shown an additional embodiments of the present disclosure. In the second, third and fourth illustrated embodiments like numerals have, where possible, been used to denote like parts, albeit with the addition of the prefix "100", "200", "300" to indicate that these features belong to the second, third and fourth embodiments respectively. The additional embodiments share many common features with the first embodiment and therefore only the differences from the embodiment illustrated in FIGS. 1 to 4 will be described in detail.

Figure 5:
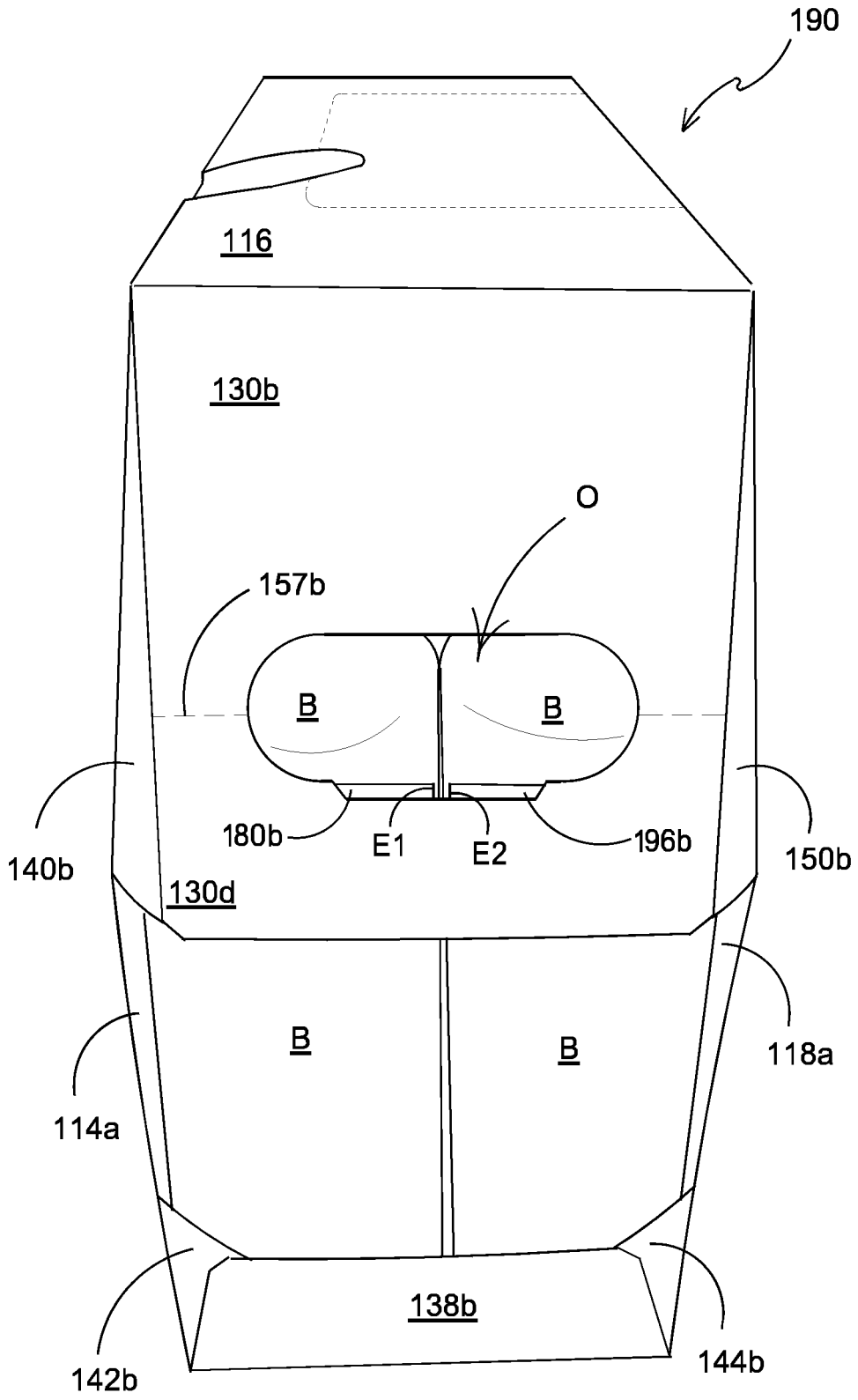
FIGS. 5 and 6 illustrate perspective views from above of an end of a carton according to second and third embodiment embodiments respectively, in the Figures a handle structure has been deployed as a carrying handle.

Turning to FIG. 5, there is illustrated a carton 190 according to a second embodiment. FIG. 5 shows the carton 190 in which the handle structure is in a deployed condition. The handle flap has been folded inwardly of the carton 190. FIG. 5 shows that the lower limbs 180*b*, 196*b* are arranged such that an end edge E1 of the lower limb 80*b* is spaced apart from an end edge E2 of the lower limb 96*b*.

Figure 6:
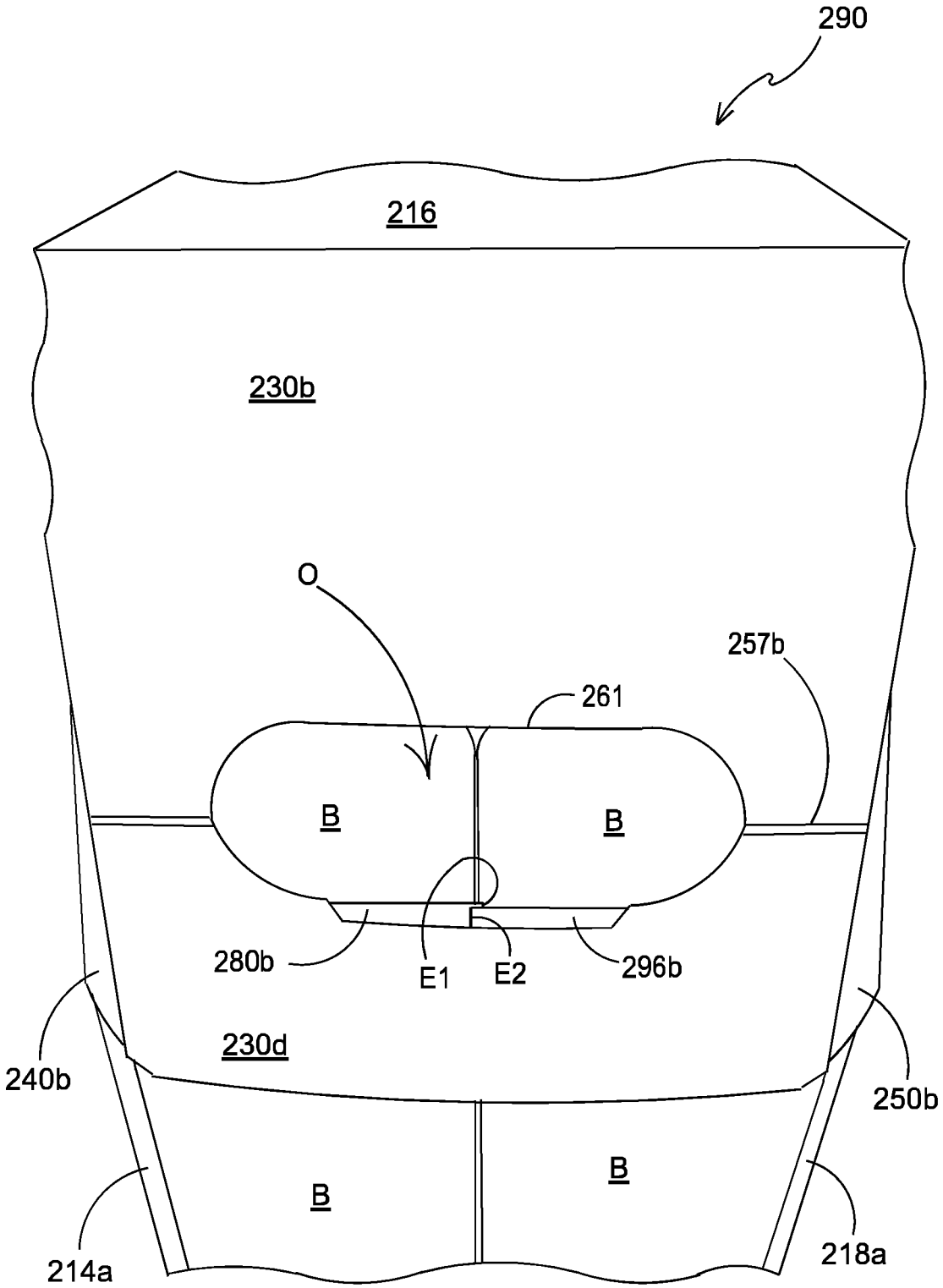

Turning to FIG. 6, there is illustrated a carton 290 according to a third embodiment. FIG. 6 shows the carton 290 in which the handle structure is in a deployed condition. The handle flap has been folded inwardly of the carton 290. FIG. 6 shows that the lower limbs 280*b*, 296*b* are arranged in a partial overlapping relationship with each other.

Figure 7:
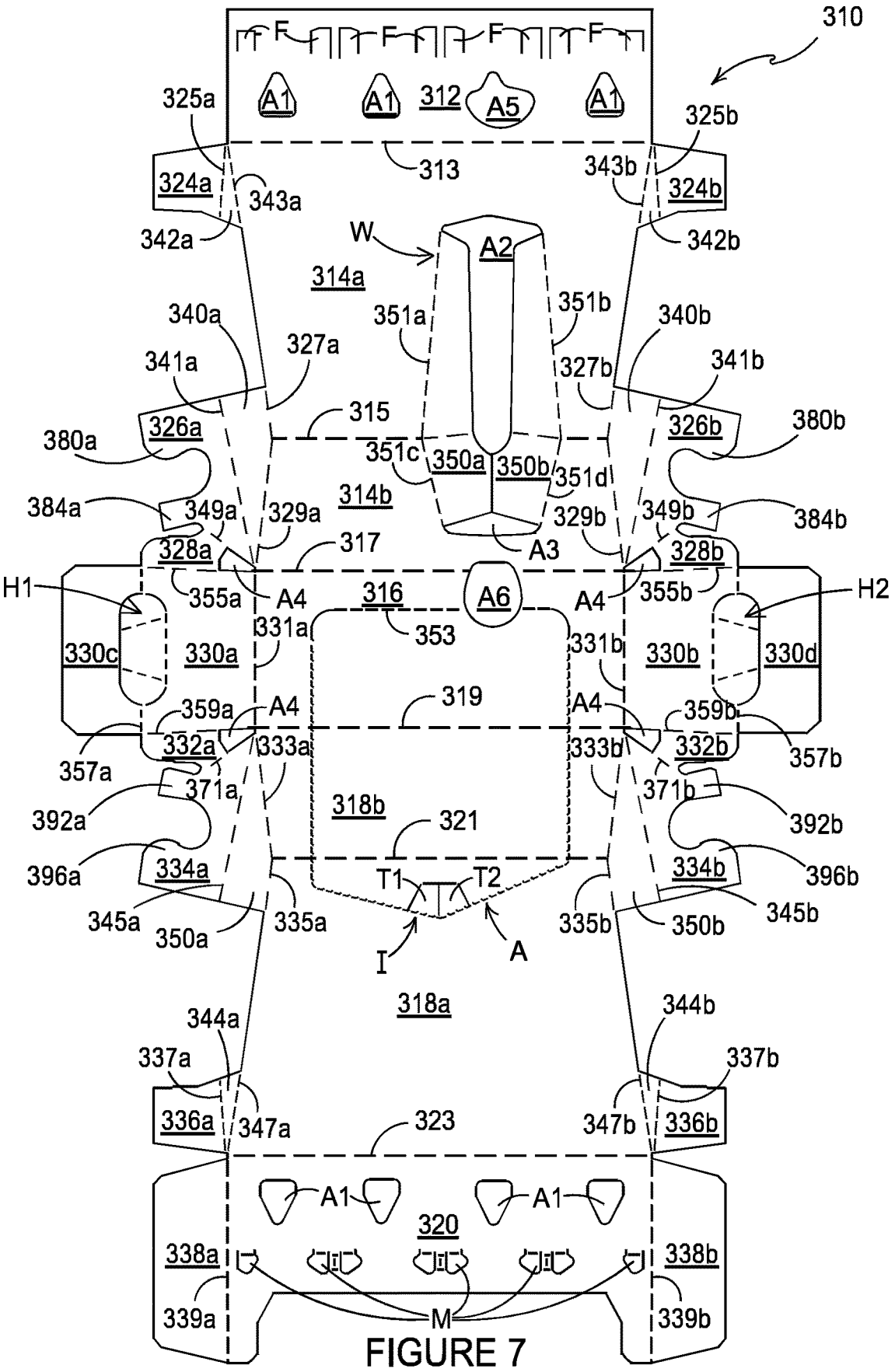
FIG. 7 is a plan view from above of a blank for forming a carton according to a fourth embodiment.
Figure 8:
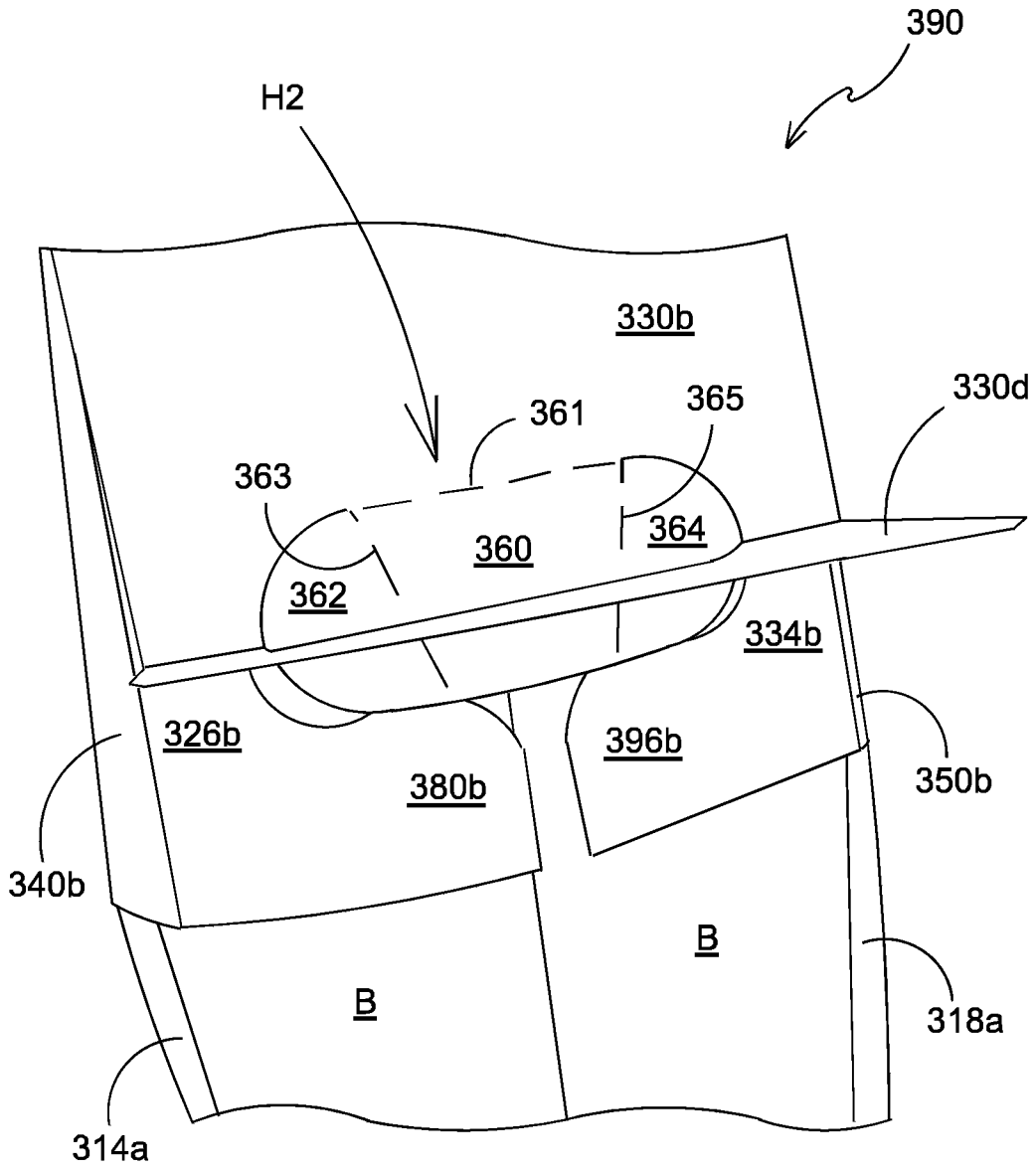
FIGS. 8 and 9 are further perspective view illustrating a stages of assembly of an end closure structure of a carton formed from the blank of FIG. 7.

Turning to FIG. 7, there is illustrated a blank 310 for forming a carton 390 according to a fourth embodiment (see FIG. 8). The blank 310 comprises a plurality of main panels 312, 314*a*, 314*b*, 316, 318*b*, 318*a*, 320 for forming a tubular structure. The plurality of main panels 312, 314*a*, 314*b*, 316, 318*b*, 318*a*, 320 comprises a first base panel 312, a first lower side panel 314*a*, a first upper side panel 314*b*, a top panel 316, a second upper side panel 318*b*, a second lower side panel 318*a* and a second base panel 320. The plurality of panels 312, 314*a*, 314*b*, 316, 318*b*, 318*a*, 320 may be arranged in a linear series hinged one to the next by corresponding fold lines 313, 315, 317, 319, 321, 323. The first upper side panel 314*b* and the first lower side panel 314*a* form a first side wall 314*a*/314*b* of a carton 390. The second upper side panel 318*b* and the second lower side panel 318*a* form a second side wall 318*a*/318*b* of a carton 390.

Figure 9:
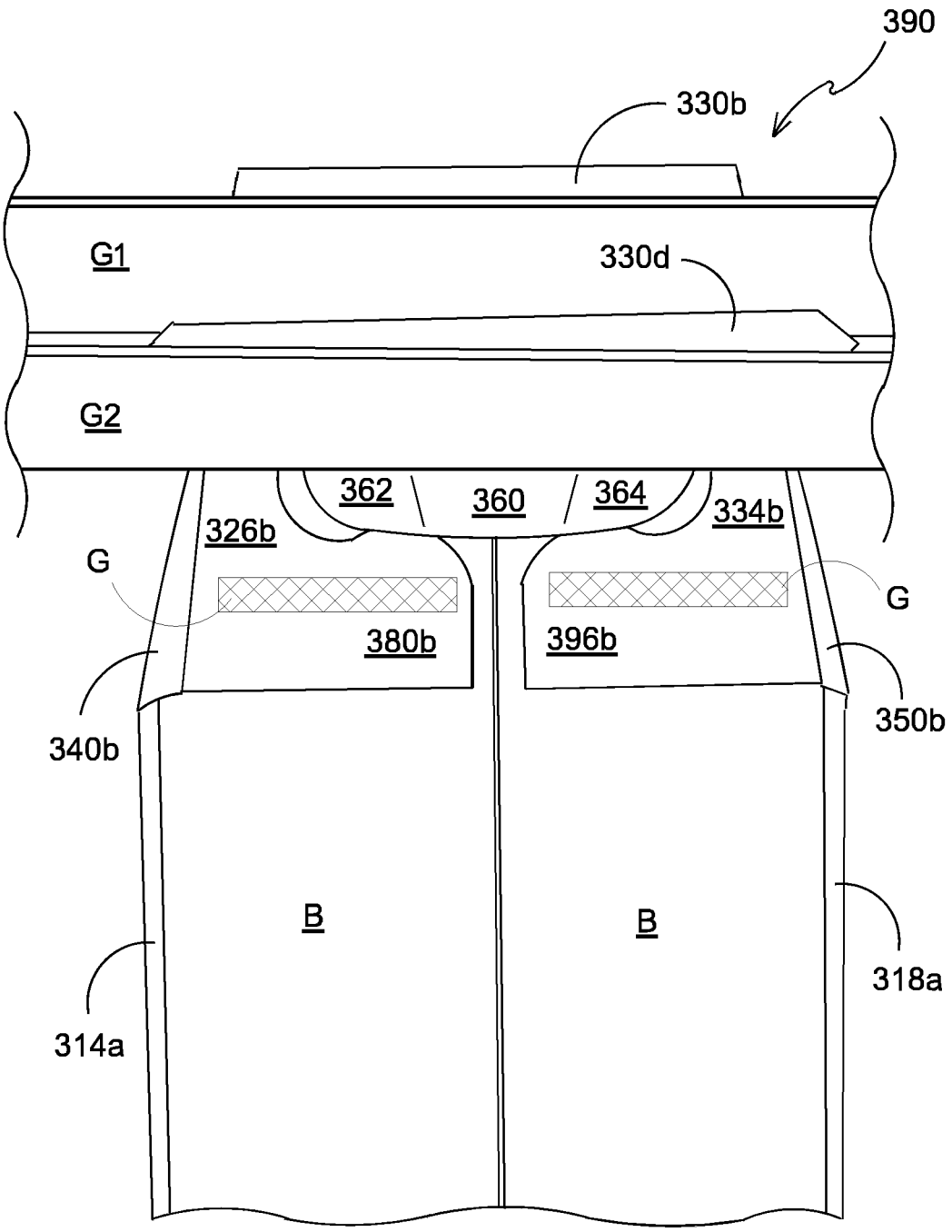
Figure 10:
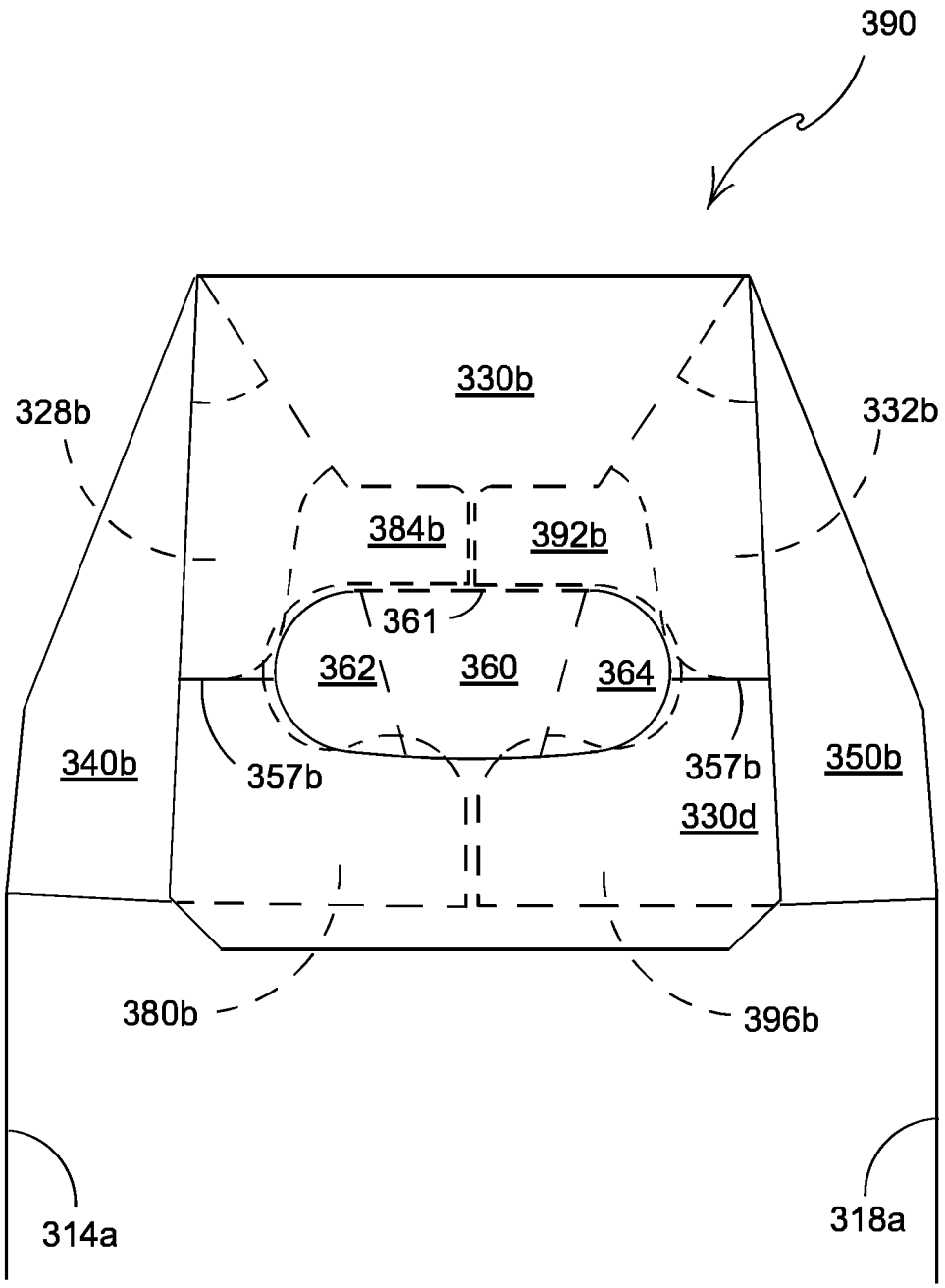
FIG. 10 is an end view of a portion of a carton formed from the blank of FIG. 7.

In the fourth illustrated embodiment the tongue 67 of the previous illustrated embodiments has been omitted. The lower limbs 380*a*, 396*a*, 380*b*, 396*b* of the first, second, third and fourth upper side end closure panels 326*a*, 334*a*, 326*b*, 334*b* respectively each comprises a projection of lobe which is extended further into the recess or cutaway defined between respective pair of upper limbs 384*a*, 392*a*, 384*b*, 392*b* and lower limbs 380*a*, 396*a*, 380*b*, 396*b*. In this way the projection or lobe engages with the handle flap 360 as shown in FIGS. 8 to 10. This engagement between the lower limbs 380*a*, 396*a*, 380*b*, 396*b* and the handle flap 360 retains the third and fourth upper side end closure flaps 326*b*, 334*b* in their folded positions (see FIG. 8) when the second lower top end closure flap 330*d* is folded upwardly, about the fold line 57*b*, with respect to the second upper top end closure flap 330*b*. The second lower top end closure flap 330*d* is folded upwardly to facilitate application of glue G or other adhesive treatment to the third and fourth upper side end closure flaps 326*b*, 334*b* as shown in FIG. 9.

In some embodiments the folding process may be carried out by a packaging machine. The machine may comprise a pair of guides G1, G2, see FIG. 9. A first guide G1 is disposed above the second lower top end closure flap 330*d* and may serve to hold or retain the second upper top end closure flap 330*b* in a folded position partially closing the open end of the tubular structure of the carton 390. This may also aid the handle flap 360 in retaining the third and fourth upper side end closure flaps 326*b*, 334*b* in a folded condition, since the first guide may be positioned so as to engage an upper portion of the handle flap 360.

A second guide G2 is disposed below the second lower top end closure flap 330*d* and may serve to fold the second upper top end closure flap 330*b* with respect to second upper top end closure flap 330*b* such that a glue applicator may apply glue to the third and fourth upper side end closure flaps 326*b*, 334*b*.

One or both guides G1, G2 may facilitate folding the second lower top end closure downwardly flap 330*d* into contact with the third and fourth upper side end closure flaps 326*b*, 334*b* so as to be secured thereto.

The present disclosure provides a carton for packaging articles; the carton may have at least one display window for presentation of an article therein. The carton comprises a plurality of panels forming walls of a tubular structure including a top wall, a first side wall, a base wall, and a second side wall, optionally hingedly connected to each other in a linear series.

The carton has a first side wall which first side wall may comprise a first display window for exposing to view an article. A pair of displaceable flaps form a frame about the article.

The carton may comprise an orientation adjustment device for enabling the orientation of an article which is at least partially exposed to view through the display window.

The article B presented in the first display window W in the first side wall may be moveable or translatable within the assembled carton. A finger or tool can be inserted through the lower aperture A5 in a composite base wall; the composite base wall is formed from the first and second base panels.

When the article B is moved an upper portion passes through the upper aperture A6 and is external of the carton. In this second deployed position the article B is readily accessible. The orientation of the article B may be adjusted by rotating the article B when in the deployed position, upon reaching the desired orientation the article B may be returned to the rest position.

The carton and the articles B form a package in which the upper portion of the article B is arranged in a rest position such that the top of the upper portion is disposed below the upper aperture A6 and is not substantially received therein.

The package or carton is arranged such that the height of the article B is no greater than the height of the carton, wherein the height of the carton is defined by the distance between the top and base panel.

The carton may comprise at least one second display window DW2 (see FIG. 2) defined in or by an end wall. The second display window DW2 exposes to view a pair of endmost articles B, particularly a label or other indicia printed or otherwise displayed on a lower or main body portion of the articles B. The articles B comprise a main body and a neck portion disposed above the main body; the neck portion comprises a smaller dimension or diameter than the main body. A shoulder region provides a transition between the main body and the neck portion. The top end closure flap is configured to obscure from view at least the neck portion.

In some embodiments, the shoulder region or an upper portion of the main body or both may be obscured from view by the top end closure flap.

The second display window DW2 is defined in part by free side edge portions of each of the first and second side walls.

In this way branding or other indicia provided upon the articles B may be displayed through the first display window W or the second display window DW2. The articles B may be arranged in a desired orientation. The displaceable flaps may bear against an article B so as to prevent or inhibit rotation of the article B away from the desired orientation.

The first and second end closure structures may be tightened so as to bear against the endmost articles B so as to prevent or inhibit rotation of the articles B away from a predefined orientation. For example, portions of the corner panels such as but not limited to a lower free edge, may bear against a respective one the endmost articles B. The upper side end closure flaps may engage the endmost articles B, with frictional forces therebetween preventing or inhibiting rotation of the articles B.

The upper side end closure panels may be aligned with, or arranged to bear against, a cap or closure portion at an upper end of an adjacent article B.

The upper side end closure panels may be aligned with, or arranged to bear against, the shoulder portion or main body of an adjacent article B.

The carton 90 comprises an end closure structure for partially closing an end of the carton. The end closure structure comprises a top end closure flap hingedly connected to the top panel, at least one side end closure flap hinged to a corner panel, and the corner panel hinged to one of the first and second side walls, wherein the at least one side end closure flap is arranged to be securable to the top end closure flap.

The corner panel may be hinged to said one of the first and second side walls by a non-linear fold line. The non-linear fold line may be configured such that the corner panel bows inwardly so as to be concave when viewed from a viewpoint external of the carton. Advantageously, this may form a biasing device for biasing the corner panel towards or against an adjacently disposed article.

The end closure structure comprises an upper side end closure flap, the upper side end closure flap may be hingedly connected to the corner panel. The upper side end closure flap may comprise a handle reinforcing portion, optionally in the form of a limb extending from a main body portion which main body portion is hinged to the corner panel. Optionally, the upper side end closure flap may be hingedly connected to one of the first and second side walls.

The end closure structure may be configured and arranged such that the top end closure flap is folded automatically in response to folding the upper side end closure flap. The end closure structure may comprise a web panel coupling the top end closure flap to the upper side end closure flap.

The end closure structure may comprise a disconnection element separating the handle reinforcing portion of the upper side end closure flap from the web panel. The disconnection element may space apart the handle reinforcing portion and the web panel to facilitate folding of the end closure structure.

The top wall of the carton may be shorter than the base wall in a longitudinal direction parallel to a tubular axis of the tubular structure formed by the plurality of main panels.

The top wall of the carton may be shorter than the base wall in a transverse direction perpendicular to the tubular axis of the tubular structure formed by the plurality of main panels.

The present disclosure further provides a method of packaging articles or a method of assembling a carton, in which the method enables the one or more end closure panels to be retained in position during assembly. The method facilitates access to said one or more panels to facilitate application of glue or other adhesive treatment.

It can be appreciated that various changes may be made within the scope of the present invention. For example, the size and shape of the panels and apertures may be adjusted to accommodate articles of differing size or shape. In alternative embodiments the web panels 44*a*, 44*b*, 46*a*, 46*b* may be omitted.

In some embodiments, the fold lines 15 and 21 may extend into the corner panels 40*a*, 40*b*, 50*a*, 50*b*.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton for packaging one or more articles comprising a plurality of panels forming walls of a tubular structure including a top wall, a first side wall, a base wall, and a second side wall, and an end closure structure for at least partially closing an end of the tubular structure, the end closure structure comprising:

a top end closure flap having a handle flap which defines at least in part a handle opening in the top end closure flap for forming a carrying handle; and a side end closure flap coupled to one of the first and second side walls;

wherein the side end closure flap comprises a portion which underlies the handle flap when both the top end closure flap and the side end closure flap are folded into an end-closing position, and wherein the top end closure flap includes a proximal portion and a distal glue flap hingedly connected to the proximal portion, wherein the handle flap is coupled to the proximal portion and separable from the distal glue flap such that the handle flap retains the side end closure flap in its end-closing position when the distal glue flap is folded out of its end-closing position.

2. A carton according to claim 1 wherein the handle flap comprises a tongue forming a retention member for holding the side end closure flap in its end-closing position.

3. A carton according to claim 1 wherein the side end closure flap comprises a limb portion extending from a main body, wherein the handle flap is disposed in overlapping relationship with at least a part of the limb portion.

4. A carton according to claim 1 wherein the side end closure flap is coupled to the top end closure flap.

5. A carton according to claim 4 wherein the end closure structure comprises a web panel interconnecting the side end closure flap and the top end closure flap.

6. A carton according to claim 1 wherein the proximal portion is coupled to the side end closure flap.

7. A carton according to claim 6 wherein the end closure structure comprises a web panel interconnecting the proximal and the top end closure flap.

8. A carton according to claim 5 wherein the web panel is hingedly connected to the top end closure flap and is hingedly connected to the side end closure flap along a fold line, and wherein the web panel is separated from the side end closure flap by a disconnection element extending from the fold line such that the disconnection element defines an upper edge of a handle reinforcing portion of the side end closure flap for reinforcing the carrying handle.

9. A carton according to claim 8 wherein the disconnection element is formed from a feature selected from the group consisting of: a cutline, a severable line, a tear line, a slit, a slot, a notch and a cutout.

10. A carton according to claim 1 wherein the end closure structure comprises a second side end closure flap, the second side end closure flap is coupled to the other one of the first and second side walls and wherein the second side end closure flap is retained in its end-closing position by the handle flap.

11. A carton according to claim 10 wherein the end closure structure comprises:

a second web panel connecting the top end closure flap to the second side end closure flap;

wherein the second web panel is hingedly connected to the top end closure flap and is hingedly connected to the second side end closure flap along a further fold line, the second web panel is separated from the second side end closure flap by a second disconnection element extending from the further fold line such that the second disconnection element defines an upper edge of a handle reinforcing portion of the second side end closure flap for reinforcing the carrying handle.

12. A carton according to claim 11 wherein the handle reinforcing portion of the side end closure flap and the handle reinforcing portion of the second side end closure flap together extend along an engaging edge of the handle opening so as to reinforce the handle opening thereacross.

13. A carton according to claim 1 wherein the carton comprises a display window defined at least in the first side wall for display of at least one article.

14. A carton according to claim 13 wherein the display window is defined at least in part by a displaceable flap hingedly connected to the first side wall.

15. A carton according to claim 1 wherein the top wall is shorter in a longitudinal direction than the base wall.

16. A carton according to claim 1 wherein the top wall is shorter in a transverse direction than the base wall.

17. A carton according to claim 1 wherein the distal glue flap is hingedly connected to the proximal portion along a glue flap fold line, wherein the handle flap is hingedly connected to the proximal portion along a handle flap fold line and wherein the handle flap fold line is disposed at a higher elevation than the glue flap fold line.

18. A carton according to claim 17 wherein the end closure structure comprises a web panel interconnecting the side end closure flap and the proximal portion of the top end closure flap.

19. A carton according to claim 18 wherein the web panel is hingedly connected to the proximal portion along a web fold line such that a lower end of the web fold line is disposed proximate or above the glue flap fold line.

20. A carton according to claim 1 wherein the handle flap is connected to the proximal portion by at least one nick such that the at least one nick is intact when the distal glue flap is folded out of its end-closing position about the glue flap fold line.

21. A carton according to claim 20 wherein the at least one nick comprises two or more nicks and wherein the two or more nicks are disposed along opposite side edges of the handle flap.

* * * * *